United States Patent [19]

Kohnhorst

[11] 4,074,722

[45] Feb. 21, 1978

[54] SMOKABLE TOBACCO PRODUCTS AND MANUFACTURING METHODS THEREFOR

[75] Inventor: Earl E. Kohnhorst, Louisville, Ky.

[73] Assignee: Brown & Williamson Tobacco Corporation, Louisville, Ky.

[21] Appl. No.: 679,710

[22] Filed: Apr. 23, 1976

[51] Int. Cl.[2] ..... A24D 1/00; A24L 5/00

[52] U.S. Cl. ..... 131/8 R; 131/20 R; 131/140 R

[58] Field of Search ..... 131/140 R, 8 R, 140 C, 131/9 R, 17 R, 1, 17 A, 2, 17 AB, 17 AC, 17 AD, 17 AE, 15 C, 108, 81 R, 109 B, 81 A, 110, 20 R, 146; 13/31, 62, 79, 109 B, 110

[56] References Cited

U.S. PATENT DOCUMENTS

| | | | |
|---|---|---|---|
| 3,136,321 | 6/1964 | Davis | 131/140 R |
| 3,141,462 | 7/1964 | Block et al. | 131/140 C |
| 3,598,826 | 1/1971 | Wochnowski et al. | 131/146 X |

*Primary Examiner*—Robert W. Michell
*Assistant Examiner*—V. Millin
*Attorney, Agent, or Firm*—William J. Mason

[57] ABSTRACT

Disclosed is a process for manufacturing smokable tobacco products through selective handling of strip tobacco based on particle size and shape. In the process, small strip tobacco is removed from bulk tobacco. The bulk tobacco is then cut to reduce its size. The removed small strip tobacco is thereafter combined with the cut tobacco. The combined cut tobacco and small strip tobacco are then passed through machinery which forms the smokable tobacco product. A specified inclusion level of small strip tobacco of total tobacco in the smokable product is thus obtained resulting in a product having improved physical and chemical properties.

36 Claims, 2 Drawing Figures

SMOKABLE TOBACCO PRODUCTS AND MANUFACTURING METHODS THEREFOR

Figure 1:
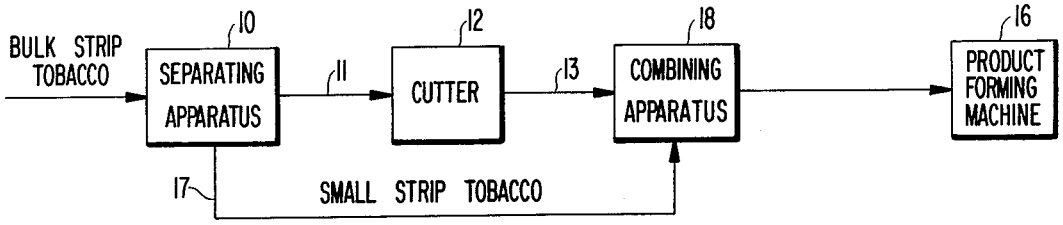

The present invention relates to smokable tobacco products and methods of manufacturing such products. In most manufacturing operations, it is generally desirable to obtain complete utilization of raw materials. This is no less true in the tobacco industry particularly in view of the high cost of the raw tobacco. In the process of manufacturing smokable tobacco products, i.e. cigarettes, primary tobacco leaf threshing and strip cutting are two unit operations where significant reductions in tobacco particle size occur. Concurrently with these size reducing operations substantial quantities of tobacco fines are produced which are either wasted or reconstituted at considerable expense.

In tobacco product manufacturing processes, the raw tobacco is threshed and stored in the form of bulk strip tobacco. This bulk strip tobacco is then conventionally cut to reduce its size for handling by tobacco product making or forming machines. A significant quantity of this bulk strip tobacco is, however, after threshing, of a size and shape small enough for processing by the cigarette making machines. Additional cutting of this portion of the bulk strip tobacco serves only to produce additional undesirable tobacco fines and tobacco dust.

Efforts to alter or modify the manufacturing process to reduce the quantity of tobacco fines and dust inevitably generated by the tobacco cutting and other unit manufacturing operations, of course, cannot ignore and ought to improve the physical and chemical properties of the resulting smokable tobacco product. Acceptance of the final smokable tobacco product by the tobacco industry and the general public depends on its physical and chemical properties. For example, product characteristics, such as firmness; loose and/or soft ends (end stability); the quantity of small particulate tobacco material or fines, nicotine, tar, etc., within the product; coal retention; density; pressure drop; number of puffs and other characteristics are highly important to the acceptance and saleability of the tobacco product. Thus, efforts to afford better utilization of tobacco raw material by changing manufacturing techniques must also provide an acceptable and improved final smokable tobacco product.

The present invention provides smokable tobacco products and methods of manufacturing which minimize or eliminate the foregoing and other problems associated with prior tobacco products and manufacturing techniques and provides novel and improved smokable tobacco products and methods of manufacturing such products in comparison with such prior tobacco products and manufacturing processes therefor. The improvements in the smokable tobacco product and the manufacturing techniques therefor are achieved principally by differentiation of small strip tobacco and cut tobacco in terms of their relative particle sizes and shapes as well as other physical and chemical properties. Previously, there have been generalized discussions of the effect of size and shape of cut or shredded tobacco particles as they affect the manufacturing process and the final tobacco product. Such discussion has appeared in three United States patents as follows: Eissman, U.S. Pat. No. 3,128,775; Dearsley, U.S. Pat. No. 2,299,895 and Ffoulkes, U.S. Pat. No. 3,138,163. However, the importance of tobacco particle size and shape and the blending or combining of tobacco particles having different geometrical classifications in the manufacturing process and in the final smokable tobacco product, particularly in connection with retention and improvement of the physical and chemical properties of such product, have not heretofore been realized or appreciated.

Reference is made throughout this specificaction to "small strip tobacco". As used herein, the term "small strip tobacco" refers to particles or pieces of bulk strip tobacco characterized by a specified size, shape, and/or distribution, both with and without comparison to cut bulk tobacco. Particularly, small strip tobacco may be defined as bulk strip tobacco having a particle size with a short dimension not in excess of about 0.5 inch and a particle shape wherein the mean ratio of area to the perimeter squared is at least about 0.049. In general, 70–80% of the small strip tobacco particles have a ratio of area to perimeter squared which lies within a range of approximately 0.037 to 0.065.

According to a preferred aspect of the present invention, small strip tobacco is removed from bulk strip tobacco in the manufacturing process. For example, the small strip tobacco can be removed by screening the bulk strip tobacco. The "overs" or bulk strip tobacco from which the small strip is removed is then cut and further processed, for example, dried. At least a portion of the small strip tobacco is then later combined with the cut tobacco and passed through conventional machinery, for example cigarette making machinery, to form the smokable tobacco product. In this manner, the final smokable tobacco product has a specific inclusion level of small strip tobacco relative to the total tobacco in the product.

Because of the characteristics of "small strip tobacco", significant savings in tobacco by substantially complete utilization of the raw tobacco material are achieved by the foregoing briefly described manufacturing process. The resulting smokable tobacco product also has unexpected improved physical and chemical properties. For example, the quantity of smaller tobacco particles or fines, which contribute little or nothing to the quality of the final tobacco product and which are otherwise wasted or expensively reconstituted, is significantly reduced in the final product. Further, significant overall reduction in the quantity of tobacco necessary to provide a smokable tobacco product having similar physical, chemical and smokable properties as corresponding conventional smokable tobacco products is achieved in comparison with the quantity of tobacco utilized in such conventional products. Also, improved firmness, end stability, and coal retention probability of the tobacco product, improved product fabrication efficiencies and reduction in the number of tobacco particles of small sizes in the final product are achieved. These improvements are, moreover, obtained without adverse effect on pressure drop and smoke delivery.

In a further aspect of the present invention, the bulk strip tobacco is cut without removal of the small strip tobacco. Small strip tobacco from another source is thereafter added to the cut tobacco. The fill value and other characteristics of the added small strip tobacco is such to provide a smokable tobacco product having improved physical and chemical properties as set forth hereinafter.

Accordingly, it is a primary object of the present invention to provide novel and improved smokable tobacco products and processes for their manufacture.

It is another object of the present invention to provide novel and improved smokable tobacco products and processes for their manufacture wherein tobacco is handled in accordance with particle size to achieve improved processing efficiency and provide a smokable tobacco product having improved physical and chemical properties.

It is another object of the present invention to provide novel and improved smokable tobacco products and processes for their manufacture wherein tobacco is handled in accordance with tobacco particle shape to achieve improved processing efficiency and provide a smokable tobacco product having improved physical and chemical properties.

It is still another object of the present invention to provide novel and improved smokable tobacco products and processes for their manufacture wherein small strip tobacco is added, in the manufacturing process, to cut tobacco and the final improved smokable tobacco product is formed from the combined cut tobacco and small strip tobacco.

It is a still further object of the present invention to provide novel and improved smokable tobacco products and processes for their manufacture wherein a significant reduction in the quantity of tobacco utilized in the improved tobacco products is achieved simultaneously with improved product fabrication efficiencies and without adverse effect on the physical and chemical properties of the final tobacco products in comparison with conventional tobacco products.

It is a related object of the present invention to provide novel and improved smokable tobacco products having improved firmness, end stability, and coal retention without adverse effect on pressure drop and smoke qualities.

It is a still further related object of the present invention to provide novel and improved apparatus for fabricating smokable tobacco products.

To achieve the foregoing and other objects and in accordance with the purpose of the present invention, as embodied and broadly described herein, the method of manufacturing smokable tobacco products from bulk tobacco includes, in one aspect, providing small strip tobacco, cutting the bulk tobacco, combining the small strip tobacco and the cut tobacco, and forming a smokable tobacco product from the combined cut tobacco and the small strip tobacco. In another aspect, the small strip tobacco is provided by separating it, preferably by screening, from the bulk strip tobacco before the bulk strip tobacco is cut. The cut tobacco and separated small strip tobacco are then combined, and the smokable tobacco product is formed from the combined cut tobacco and separated small strip tobacco.

In a further aspect of the present invention, the manufacturing method includes providing uncut tobacco characterized by particle sizes having a short dimension not in excess of about 0.5 inch, cutting the bulk tobacco, combining the uncut tobacco and the cut bulk tobacco, and forming the smokable tobacco product from the combined uncut tobacco and the cut bulk tobacco.

A related aspect of this invention provides a smokable tobacco product including cut tobacco and small strip tobacco wherein the small strip tobacco consists of bulk strip tobacco having a particle size with a short dimension not in excess of about 0.5 inch and a particle shape wherein the mean ratio of the area to the perimeter squared is at least about 0.049, the small strip tobacco having an inclusion level in the tobacco product no less than 2% by weight of the total tobacco in the product.

Figure 2:
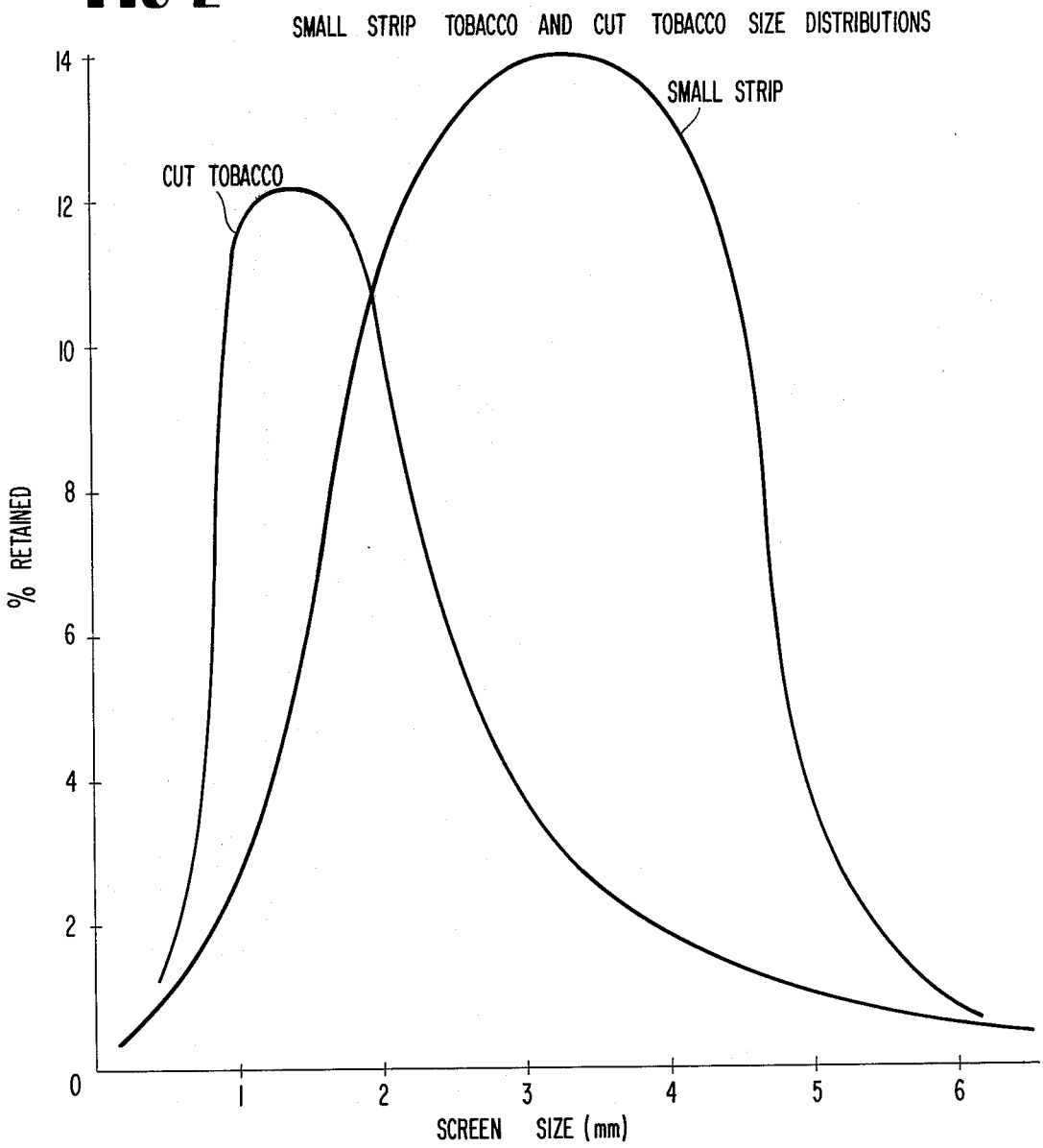

A further related aspect of the present invention includes the apparatus for manufacturing the smokable tobacco products and which apparatus comprises means for separating small strip tobacco from bulk strip tobacco, means for cutting the remaining bulk strip tobacco, means for bypassing the small strip tobacco about the cutting means and combining the small strip tobacco and cut bulk tobacco, and means for fabricating the smokable tobacco product from the combined small strip tobacco and cut bulk tobacco. These and other aspects of the invention will become more apparent upon reference to the following specification, appended claims and drawings in which;

FIG. 1 is a schematic flow diagram illustrating an apparatus and process for manufacturing smokable tobacco products in accordance with the present invention; and FIG. 2 is a graphical representation of typical particle size distribution curves for small strip tobacco particles and cut tobacco particles.

Referring to FIG. 1, there is schematically illustrated apparatus for the manufacture of improved smokable tobacco products in accordance with the present invention and including a tobacco separator, generally indicated 10. Separator 10 may comprise a screen over which cased or bulk strip tobacco, from a source, not shown, is passed. As amplified hereinafter, small strip tobacco is removed as the material passing through the screen. The "overs" or bulk strip tobacco which does not pass through the screen as small strip tobacco is conveyed along flow path 11 to a conventional cutting mechanism or cutter generally indicated 12. The bulk strip tobacco, without the small strip tobacco, is then cut by mechanism 12 to reduce its size for handling by the tobacco product making or forming machines schematically illustrated at 16. After the tobacco is cut, it is conveyed along a flow path 13 through a number of processing stages, not shown, toward the tobacco product making machines schematically illustrated at 16.

In a preferred form of the present invention, the removed small strip tobacco is suitably conveyed along a flow path 17 to a combining apparatus 18, for example a rotating cylinder. This apparatus 18 combines the small strip tobacco and the cut tobacco conveyed along path 13. The small strip tobacco thus bypasses the cutting operation, to which the bulk strip tobacco passing over screen 10 is subjected, and is combined with the cut tobacco at a processing stage before the tobacco is conveyed to the product making or forming machinery 16. The small strip tobacco and cut tobacco are combined such that the small strip tobacco is substantially uniformly distributed in the cut tobacco. It will be understood there may be intervening processing stages between the cutting and combining stages, e.g. drying, as well as between the combining and product forming stages. The forming machinery, of course, disposes the combined small strip and cut tobacco within a wrapper, for example paper, in rod form and cuts the rod to the appropriate length to form the final smokable product.

The equipment for manufacturing the smokable tobacco product including cutting the bulk strip tobacco and forming the product is per se conventional and further description is not believed necessary. The resulting product obtains, however, a specific inclusion level of small strip tobacco relative to the total tobacco in the final product as described further hereinafter.

It is believed that cutting bulk strip tobacco including the small strip tobacco occurring in the bulk strip tobacco at the cutter, for example at 30 cuts per inch, serves only to produce still smaller particles or fines which contribute little or nothing to cigarette physical quality. It will be recalled that the small strip tobacco is sufficiently small in size for direct handling by the making machines. Thus, separating the smll strip tobacco from the bulk strip tobacco before cutting and bypassing the small strip tobacco about the conventional cutting stage reduces the fines contained in the final tobacco product. Further, it is believed that the small strip tobacco has a larger filling value than normal cut tobacco as demonstrated in detail hereinafter. Accordingly, when small strip tobacco is combined with cut tobacco, it fills and firms the final smokable product to a greater extent than does cut tobacco. As a result, a lesser quantity of tobacco is required to achieve a cigarette having physical and chemical properties comparable to conventional cigarettes.

Before describing the characteristics of small strip tobacco, it will be appreciated that the small strip tobacco combined with the cut tobacco at apparatus 18 need not necessarily comprise the same tobacco removed from the bulk strip tobacco as it passes over the screen. That is, the addition or add-back of small strip tobacco is, in the process, independent of removal of small strip tobacco from the bulk strip tobacco except that small strip tobacco is added into the main process flow after the bulk strip tobacco is cut.

Further, because of the unusual and unexpected increase in the filling power of small strip tobacco, an improved smokable tobacco product according to the present invention is formed simply by adding small strip tobacco to the cut tobacco even without prior removal of the small strip tobacco.

The improved physical and chemical properties of the smokable tobacco product are principally dependent upon the physical and chemical characteristics of the small strip tobacco itself. Particularly, it is believed that such improved properties are obtained by providing and adding tobacco particles to the cut tobacco of a size having a short dimension not in excess of about 0.5 inch. Preferably, however, small strip particles having a short dimension not in excess of about 0.365 are provided and are separated from the bulk strip tobacco by screening through a 2½ mesh. Further, it has been found that such improved properties are obtained by providing small strip tobacco comprised of particles having an arithmetic mean size of at least 1.93 mm and a geometric mean size of at least 1.74 mm. Moreover, the density of the small strip tobacco is substantially the same as the density of cut tobacco and has a density of at least 0.6603 gm/cc.

It will be appreciated that the size of the particles removed is the significant factor rather than the process or apparatus used to segregate or separate the small strip particles from the larger particles. Thus, while the apparatus for separating small strip tobacco and bulk strip tobacco herein disclosed comprises screens, it will be appreciated that other apparatus and methods to effect such separation may be employed. For example, air classifying through elutriation, particle trajectory or sizing screens may be utilized. In the normal process of separation, approximately 7–10 percent of the bulk strip tobacco is removed as small strip tobacco by the separating operation in accordance with the present invention.

Referring to FIG. 2, there is illustrated representative particle size distribution curves for small strip tobacco particles and cut tobacco particles; those resulting from cutting the "overs" conveyed along flow paths 11 and 13 in FIG. 1. As illustrated, the distribution curve for traditionally cut tobacco particles is shifted or skewed to the left. Thus, smaller particle sizes dominate and the distribution of cut tobacco particles is a typical log-normal curve. In contrast, however, the distribution curve for particles of small strip tobacco is a typical substantially symmetrical bell-shaped curve. The particle size distribution for small strip tobacco is thus unexpectedly approximately normal.

Small strip tobacco is also classified according to its shape. To accomplish this, a form factor ($A/P^2$) has been chosen where A is the area of the substantially planar particle and P is its perimeter. The following Table I illustrates a comparison of the form factor ($A/P^2$) distributions for small strip tobacco and cut tobacco in terms of their mean, standard deviation, skewness and kurtosis.

TABLE I

| | Small Strip Tobacco | Cut Tobacco (30 cpi) |
|---|---|---|
| Mean ($A/P^2$) | 0.049 | 0.034 |
| Standard Deviation | 0.012 | 0.015 |
| Skewness | −0.95 | 0.08 |
| Kurtosis | 4.07 | 2.35 |

As evident from Table I and as distinguished from cut tobacco, small strip tobacco particle shape has a mean form factor ($A/P^2$) of at least 0.049. Also from the mean values of ($A/P^2$) given in Table I, the shape of small strip tobacco can be approximated by rectangles with sides *a*, 0.38*a*; whereas cut tobacco particles appear as rectangles with sides *a*, 0.19*a*. The standard deviation in Table I demonstrates that most small strip tobacco particles appear as rectangles with sides ranging from *a*, 0.22*a* up to *a*, 0.73*a*. Most cut tobacco particles, in contrast, appear within a range from *a*, 0.09*a* up to *a*, 0.37*a*. The skewness value of the small strip shape factor distribution from Table I shows that the ($A/P^2$) values of small strip particles are shifted toward rectangles of sides *a*, 0.37*a* and larger. On the other hand, the skewness value for cut tobacco indicates a symmetric distribution of shape factor ($A/P^2$) about the mean.

From the kurtosis values, the small strip tobacco shape factors and hence the shape distribution of the small strip particles are more likely to be found in a narrow range of values; whereas, the shape factors of cut tobacco and hence the shape distribution of its particles lie over a wide range of values.

Table II below provides ranges for the shape factor for both cut tobacco and small strip tobacco.

TABLE II

| ($A/P^2$) SHAPE FACTOR RANGES | |
|---|---|
| Cut Tobacco | Small Strip |
| 0.019 – 0.049 | 0.037 – 0.065 |

These ranges were calculated from data given in Table I and 70–80% of the small strip tobacco and cut tobacco particles will lie within the given ranges. It is noted that the shape factor for cut tobacco at the high end of its range has a value of 0.049 and which value corresponds identically to the mean shape factor for small strip tobacco given in Table I.

The physical and chemical properties of the smokable tobacco product formed in accordance with the present invention utilizing the processes described above will now be set forth. The small strip samples identified in Table III below were obtained using the process according to FIG. 1. In general, bulk strip tobacco used in commercial manufacturing operations was separated by screening. Small strip tobacco was removed as the material passing through the screens. The "overs" from the screening were conveyed along flow path 11 and processed normally through the cutting mechanism 12. The small strip tobacco was then combined with or added to the cut tobacco. Finally, cigarettes were fabricated. Process parameters were varied by changing the screen size, i.e. the small strip tobacco size, and fabrication was varied by using two different types of standard equipment. At the same time, control samples were produced from the same lot of tobacco as the test samples.

The test results are set forth in Table III and are shown on a relative basis compared to the control samples.

The following definitions are provided to facilitate interpretation of these test results:

TABLE III

MAJOR IMPROVEMENTS BY PERCENTAGE [1]

| Property | Cigarette Code | | |
|---|---|---|---|
| Sample | A | B | C |
| Screen Size | −4 mesh (.215") | −3 mesh (.286") | −2½ mesh (.365") |
| Small Strip Yield | 3.1 | 6.7 | 7.3 |
| Firmness | 5.4 | 9.1 | 7.9 |
| End Stability | 19.4 | 16.7 | 25.0 |
| Coal Retention Probability | ND[2] | 13.3 | ND[2] |
| % - 14 mesh | 17.6 | 18.2 | 10.9 |
| % - 32 mesh | 17.4 | 20.0 | −17.4[3] |
| Tobacco Section Pressure Drop | 0 | 0 | 0 |
| TSPD Relative Standard Deviation | 5.9 | ND[2] | 0.8 |
| Puffs | 0 | 0 | 0 |
| Tar Delivery | 0 | 0 | 0 |
| Nicotine Delivery | 0 | 0 | 0 |

[1]Relative to Control Samples
[2]ND - No data available
[3]Believed to be sampling error Tobacco Section Pressure Drop — the resistance to air flow in the tobacco rod measured in inches of water pressure loss.

TSPD — Relative Standard Deviation — a measure of the range of the pressure drop measurement compared to its mean.

Firmness — the ability of a cigarette to withstand an applied compressive force.

End Stability — the measure of a cigarette's resistance to form void, loose, or soft ends.

Coal Retention Probability — the ability of a cigarette to retain its coal for a specified duration of tapping.

Trends in the properties of the resulting cigarette samples in relation to the size or amount of material are evident from a review of Table III. Firmness results demonstrate improvement for all three by-pass samples. The greatest improvement is 9.1% for the −3 mesh (B) sample. The trend with respect to size indicates that −3 mesh material is the optimum by-pass size.

Particle size data show reductions in fines included in the cigarettes. The −3 mesh (B) sample shows the greatest improvement in reducing both −14 mesh and −32 mesh fine material in the final product. Such waste material is reduced by about 20%. The trends with respect to size indicate an optimum at the 3 mesh level.

Furthermore, end stability of all three by-pass samples was improved. A maximum improvement of 25% was obtained with the 2½ mesh sample (C) by-pass material. The tobacco section pressure drop was not adversely affected by the inclusion in the cigarette samples of small strip tobacco. In some cases, the test samples were slightly lower in pressure drop than the control but this was not statistically significant. Unexpectedly, the relative variablity of the pressure drop was lower in the test samples than in the control.

Referring to Table III, it can be seen that there were no significant changes in puffs or smoke deliveries from test samples to control samples. Consequently, although significant changes were made in the physical properties of the cigarettes, the inclusion of small strip tobacco does not affect adversely the smoke properties of the cigarettes. Additionally, the chemical composition of small strip tobacco is substantially the same as the chemical composition of cut tobacco.

Small strip tobacco samples were also obtained by screening portions of commercial grade strip tobacco. The screen unit was fitted with 3-mesh (0.286 inch opening with a 73.6% open area) screens. Small strip tobacco was removed as the −3 mesh material. The average percent removed was 7.4% with a range of 0.8%. This small strip tobacco was tested for fill value. The mean result for small strip tobacco was 6.03 cc/gm while the mean result for cut tobacco was 4.52 cc/gm. This value is a vibrating/compression fill value corrected to 13.0% moisture.

The inclusion level of small strip tobacco relative to the total tobacco in the cigarette rod is a significant factor in obtaining the improved smokable tobacco product of this invention. As will be recalled, small strip tobacco occurs naturally in bulk strip tobacco and conventional cigarettes have an inclusion level of small strip tobacco relative to total tobacco of about 1.0% by weight. This included small strip tobacco comprises in part cutter flags. Inclusion of small strip tobacco was previously believed detrimental to product quality. It has been determined, however, that an inclusion level of small strip tobacco relative to total tobacco between 2–25% provides the advantageous results hereof. While inclusion levels above a 25% can be provided, practical problems in blending may occur. Thus, inclusion levels of between 2–25% of small strip tobacco relative to total tobacco in the cigarette rod are practical and achieve the advantages of the present invention.

It is apparent from the foregoing specification that the objectives set forth in this invention are fully achieved. Principally, substantially complete utilization of raw materials is obtained by reducing the production of fines in the manufacturing process and hence in the final tobacco product. Further, greater utilization of the raw tobacco material is achieved by manufacture of a tobacco product having similar physical and chemical properties as conventional products but which product utilizes less tobacco.

Significantly, cigarettes manufactured utilizing the preferred small strip bypassing method according to this invention have increased firmness, improved end stability, and fewer fines, without adverse effect on pressure drop or smoke deliveries. Fabrication efficiencies are also improved.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by United States Letters Patent is:

1. A method of manufacturing smokable tobacco products from bulk tobacco comprising:

providing uncut tobacco characterized by particle sizes having a short dimension not in excess of about 0.5 inch, and an arithmetic mean size of at least 1.93 mm, cutting the bulk tobacco, combining the uncut tobacco and the cut bulk tobacco, and forming a smokable tobacco product from the combined uncut tobacco and the cut bulk tobacco.

2. A method according to claim 1 wherein the uncut tobacco particles are characterized by a substantially normal particle size distribution, and cutting the bulk tobacco to particle sizes characterized by a substantially log-normal particle size distribution.

3. A method according to claim 1 wherein at least 70% of the uncut tobacco particles are characterized by a shape factor ($A/P^2$) within a range of 0.037 to 0.065, wherein A is the area of the particle and P is its perimeter.

4. A method according to claim 1 wherein the step of providing includes separating uncut tobacco characterized by particle sizes having a short dimension not in excess of about 0.5 inch from the bulk tobacco before the bulk tobacco is cut.

5. A method according to claim 4 wherein at least 70% of the uncut tobacco particles are characterized by a shape factor ($A/P^2$) within a range of 0.37 to 0.065, wherein A is the area of the particle and P is its perimeter.

6. A method according to claim 4 including combining the separated uncut tobacco and the cut tobacco, and forming the smokable tobacco product from the combined cut tobacco and separated uncut tobacco.

7. A method according to claim 1 including combining the uncut tobacco and the cut tobacco in an amount such that the uncut tobacco does not exceed by weight approximately 25 percent of the combined weight of the cut tobacco and uncut tobacco.

8. A method according to claim 1 including combining the uncut tobacco and the cut tobacco in an amount such that the uncut tobacco lies within a range of about 2–25 percent by weight of the combined weight of the cut tobacco and uncut tobacco.

9. A method according to claim 8 wherein the step of providing includes separating uncut tobacco characterized by sizes having a short dimension not in excess of about 0.5 inch from the bulk tobacco before the bulk tobacco is cut.

10. A method according to claim 9 including combining

11. A method according to claim 1 wherein the uncut tobacco particles are characterized by a substantially normal particle size distribution, and the cut bulk tobacco particles are characterized by a substantially log-normal particle size distribution, at least 70% of the uncut tobacco particles being characterized by a shape factor ($A/P^2$) within a range of 0.037 to 0.065, wherein A is the area of the particle and P is its perimeter, the step of providing including separating uncut tobacco characterized by particle sizes having a short dimension not in excess of about 0.5 inch and an arithmetic mean size of at least 1.93 mm, from the bulk tobacco before the bulk tobacco is cut, combining the separated uncut tobacco and the cut tobacco in an amount such that the uncut tobacco does not exceed by weight 25 percent of the combined weight of the cut tobacco and uncut tobacco, and forming the smokable tobacco product from the combined cut tobacco and separated uncut tobacco.

12. A method of manufacturing smokable tobacco products comprising:

providing small strip tobacco characterized by particle sizes having a short dimension not in excess of about 0.5 inch, an arithmetic mean size of at least 1.93 mm, and a particle shape wherein the mean ratio of area to perimeter squared is at least about 0.049;

cutting the bulk tobacco;

combining the cut tobacco and the small strip tobacco; and forming a smokable tobacco product from the combined cut tobacco and small strip tobacco.

13. A method according to claim 12 wherein the small strip tobacco is characterized by a substantially normal particle size distribution, and cutting the bulk tobacco to particle sizes characterized by a substantially log-normal particle size distribution.

14. A method according to claim 12 wherein at least 70% of the small strip is characterized by particles having a shape factor ($A/P^2$) within a range of 0.037 to 0.065, wherein A is the area of the particle and P is its perimeter.

15. A method according to claim 12 wherein the step of providing includes separating small strip tobacco from the bulk tobacco before the bulk tobacco is cut, the latter small strip tobacco being characterized by particle sizes having a short dimension not in excess of about 0.5 inch, an arithmetic mean size of at least 1.93 mm, and a particle shape wherein the mean ratio of area to perimeter squared is at least 0.049.

16. A method according to claim 15 wherein at least 70% of the small strip tobacco is characterized by a shape factor ($A/P^2$) within a range of 0.037 to 0.065, wherein A is the area of the particle and P is its perimeter.

17. A method according to claim 16 including combining the separated small strip tobacco and the cut tobacco, and forming the smokable tobacco product from the combined cut tobacco and separated small strip tobacco.

18. A method according to claim 12 including combining the small strip tobacco and the cut tobacco in an amount such that the small strip tobacco does not exceed by weight about 25 percent of the combined weight of the cut tobacco and small strip tobacco.

19. A method according to claim 12 including combining the small strip tobacco and the cut tobacco in an amount such that the small strip tobacco lies within a range of about 2–25 percent by weight of the combined weight of the cut tobacco and small strip tobacco.

20. A method according to claim 19 wherein the step of providing includes separating small strip tobacco from the bulk tobacco before the bulk tobacco is cut, the latter small strip tobacco being characterized by particle sizes having a short dimension not in excess of about 0.5 inch, an arithmetic mean size of at least 1.93 mm, and a particle shape wherein the mean ratio of area to perimeter squared is at least about 0.049.

21. A method according to claim 20 including combining the separated small strip tobacco and the cut tobacco and forming the smokable tobacco product from the combined cut tobacco and separated small strip tobacco.

22. A method of manufacturing smokable tobacco products from bulk tobacco comprising:

screening bulk tobacco to separate out small strip tobacco, said small strip tobacco being characterized by particle sizes having a short dimension not in excess of about 0.5 inch, and an arithmetic mean size of at least 1.93 mm, cutting the bulk tobacco after the small strip tobacco has been separated therefrom;

combining small strip tobacco and the cut bulk tobacco; and forming a smokable tobacco product from the combined small strip tobacco and the cut bulk tobacco.

23. A method according to claim 22 wherein the small strip tobacco particles are characterized by a substantially normal particle size distribution, and cutting the bulk tobacco to particle sizes characterized by a substantially log-normal particle size distribution.

24. A method according to claim 22 wherein at least 70% of the small strip tobacco is characterized by particles having a shape factor ($A/P^2$) within a range of 0.037 to 0.065, wherein A is the area of the particle and P is its perimeter.

25. A method according to claim 22 including combining the separated small strip tobacco and the cut tobacco, and forming the smokable tobacco product from the combined cut tobacco and separated small strip tobacco.

26. A method according to claim 25 wherein the small strip tobacco is characterized by particle sizes having a short dimension not in excess of 0.365 inch.

27. A method according to claim 22 including combining small strip tobacco and the cut tobacco in an amount such that the small strip tobacco does not exceed by weight 25 percent of the combined weight of the cut tobacco and small strip tobacco.

28. A method according to claim 22 including combining small strip tobacco and the cut tobacco in an amount such that the uncut tobacco lies within a range of 2–25 percent by weight of the combined weight of the cut tobacco and small strip tobacco.

29. Apparatus for manufacturing smokable tobacco products comprising:

means for separating small strip tobacco from bulk strip tobacco, said small strip tobacco being characterized by particle sizes having a short dimension not in excess of about 0.5 inch, and an arithmetic mean size of at least 1.93 mm, means for cutting the remaining bulk strip tobacco, means for bypassing the small strip tobacco about the cutting means and combining the small strip tobacco and cut bulk tobacco, and means for fabricating a smokable tobacco product from the combined small strip tobacco and cut bulk tobacco.

30. Apparatus according to claim 29 wherein said separating means includes a screen.

31. Apparatus according to claim 29 wherein said combining means includes a rotating cylinder in which the small strip tobacco and cut bulk strip tobacco are received whereby the small strip tobacco is substantially uniformly distributed in the cut bulk strip tobacco.

32. A smokable tobacco product comprised of cut tobacco and small strip tobacco wherein said small strip tobacco consists of bulk strip tobacco having a particle size with a short dimension not in excess of about 0.5 inch, an arithmetic mean size of at least 1.93 mm, and a particle shape wherein the mean ratio of the area to the perimeter squared is at least about 0.049, the small strip tobacco having an inclusion level in the tobacco product no less than 2% by weight of the total tobacco in the product.

33. a smokable tobacco product according to claim 32 wherein the small strip tobacco particles have a geometric mean size at least 1.74 mm.

34. A smokable tobacco product according to claim 32 wherein the small strip tobacco particles have a density of at least 0.6603 gm/cc.

35. A smokable tobacco product according to claim 32 including a wrapper for containing said cut tobacco and small strip tobacco, said small strip tobacco being substantially uniformly distributed in the cut tobacco.

36. A smokable tobacco product according to claim 35 wherein said small strip tobacco has a particle size no greater than 0.365 inch.

* * * * *

UNITED STATES PATENT AND TRADEMARK OFFICE

CERTIFICATE OF CORRECTION

PATENT NO. : 4,074,722

DATED : February 21, 1978

INVENTOR(S) : EARL E. KOHNHORST

It is certified that error appears in the above-identified patent and that said Letters Patent are hereby corrected as shown below:

Column 5, Line 8, "smll" should be --small--.

Column 9, Line 57, after "combining" insert --the separated uncut tobacco and the cut tobacco, and forming the smokable tobacco product from the combined cut tobacco and separated cut tobacco.--.

Column 12, Line 34, "a" should be --A--.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*